US006354385B1

(12) United States Patent
Ford et al.

(10) Patent No.: US 6,354,385 B1
(45) Date of Patent: Mar. 12, 2002

(54) ROTARY DRILLING HEAD ASSEMBLY

(75) Inventors: Garland Vance Ford, Odessa; Gary Pfannenstiel, Midland; Glenn L. Allison; Jaye M. Shelton, both of Spring, all of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/479,953

(22) Filed: Jan. 10, 2000

(51) Int. Cl.[7] ..... E21B 3/03
(52) U.S. Cl. ..... 175/195; 166/84.3
(58) Field of Search ..... 175/162, 195, 175/210, 65, 173, 214, 215, 324, 329; 166/82, 84.3; 384/490, 420, 492, 3.4, 308, 305, 907.1

(56) References Cited

U.S. PATENT DOCUMENTS

| | | | | | |
|---|---|---|---|---|---|
| 3,724,862 | A | * | 4/1973 | Biffle | 277/31 |
| 4,281,724 | A | * | 8/1981 | Garrett | 175/195 |
| 4,293,047 | A | | 10/1981 | Young | 175/195 |
| 4,363,357 | A | | 12/1982 | Hunter | 166/84 |
| 4,406,333 | A | | 9/1983 | Adams | 175/209 |
| 4,410,054 | A | * | 10/1983 | Nagel et al. | 175/107 |
| 4,526,243 | A | | 7/1985 | Young | 175/195 |
| 4,745,970 | A | | 5/1988 | Bearden et al. | 166/84 |
| 4,783,084 | A | | 11/1988 | Biffle | 277/9 |
| 5,022,472 | A | | 6/1991 | Bailey et al. | 175/195 |
| 5,037,212 | A | * | 8/1991 | Justman et al. | 384/97 |
| 5,364,192 | A | * | 11/1994 | Damm et al. | 384/420 |
| 5,560,716 | A | * | 10/1996 | Tank et al. | 384/492 |

OTHER PUBLICATIONS

Halliburton Energy Services, Inc.,; *Dyna–Drill Handbook*; Ninth Edition, Jun. 1998 (pp. 2–9–2–12).
Smith International, Inc.; Drilco.Grant; *Rotating Drilling Heads*; (undated); (pp. 8).

* cited by examiner

*Primary Examiner*—Robert E. Pezzuto
(74) *Attorney, Agent, or Firm*—Conley, Rose & Tayon, P.C.

(57) ABSTRACT

The rotary drilling head assembly of the present invention includes a housing having a bore for receiving a drive member. The drive member has an outer diameter of less than 17 ½ inches to pass through a 17½ inch opening in a rotary table. A bearing assembly is disposed between the housing and drive member allowing the drive member to rotate within the housing and includes an outer stationary portion and an inner rotating portion. Retaining clamps attach the outer stationary portion to the housing and the rotating portion to the drive member. Rotary seal assemblies isolate the bearing assembly and its lubrication system from the drilling fluid and prevent premature wear and failure of the bearing. The bearing assembly includes a plurality of opposing disc-like members that have flat bearing surfaces meeting on a substantially planar surface of contact. The disc-like members are preferably made of a polycrystalline diamond material.

27 Claims, 6 Drawing Sheets

ROTARY DRILLING HEAD ASSEMBLY

BACKGROUND OF THE INVENTION

The invention generally relates to rotary drilling heads for the oil industry and more particularly to a rotary drilling head that includes a diamond enhanced bearing assembly which can be retrieved through the rotary table of the drill rig and which increases rotational drilling speeds and lengthens service intervals.

Referring initially to FIG. 1, there is shown a conventional rig 10 for rotating a drill bit 12 on the end of a drill string 14 for drilling a well bore 16. The drilling rig 10 includes a rotary table 18 located on the floor 20 of rig 10 for transmitting torque to the drill string 14. The drill string 14 extends through a blowout preventer ("BOP") stack located beneath the rig floor 20 and includes a kelly 22 at its upper end and a plurality of drill pipes 24 including a plurality of drill collars 26 connected at it lower end to the drill bit 12. The drill string 14 transmits rotational and axial movements to the drill bit 12 for drilling the well bore 16.

Referring now additionally to FIGS. 2 and 3, there is shown a typical kelly 22 having threaded rotary shouldered connections 28 at its top and bottom and a center section 30 with a polygonal outer cross section. The rotary table 18 includes a clearance hole, typically 17.5" or 22.5" in diameter, for housing a drive bushing that corresponds to the polygonal geometry 30 of kelly 22 for applying torque to kelly 22. Kelly 22 in turn transmits torque to the drill string 14 and bit 12 at the bottom of well bore 16.

Drilling fluids, often referred to as drilling mud, are pumped downward through the flowbore of the drill string 14 under high pressure, through drill bit 12 and then returns upwardly via the annulus 44 formed between well bore 16 and drill string 14 to remove the cuttings to the surface. The returning mixture of drilling fluids and cuttings is diverted beneath the rig floor 20 to a mud reservoir by means of a device commonly referred to in the industry as a rotary drilling head assembly 46.

A rotary drilling head assembly 46 is typically mounted below the floor 20 of the drilling rig 10 on the top of the BOP stack to redirect the drilling fluid returning from the well bore 16 and to allow rotation and deployment of the drill string 14 through the rotary table 18. During normal drilling operations, the blowout preventers are maintained in the "open" position, leaving only the rotary drilling head to divert the returning pressurized drilling fluids away from the rig 10.

FIG. 2 illustrates a typical prior art rotary drilling head assembly 46 having an outer stationary housing or bowl 48 and an inner drive ring 50 with a bearing assembly 52 disposed in between allowing drive ring 50 to rotate within bowl 48. Outer bowl 48 includes a flange 54 for mounting the assembly 46 to the BOP stack and a flow diverter port or outlet 56 having a flange 58 for the attachment of a pipe extending to the mud reservoir. Assembly 46 further includes an inner stripper assembly 60 slidably received within drive ring 50 and connected to the upper end of drive ring 50 by a retaining clamp 62 allowing stripper assembly 60 to rotate with inner drive ring 50. Stripper assembly 60 includes an outer housing 66 bonded by a rubber insert 68 to inner drive bushing 32. The lower end of outer housing 66 is bolted to a flange 64 which is bonded onto stripper rubber 42. A primary non-rotary seal 70 and a secondary non-rotary seal 72 serve to statically seal the outside of stripper assembly 60 from bearing assembly 52 and rig floor 20. Bearing assembly 52 includes an upper set of roller bearings 74 and a lower set of roller bearings 76. Upper and lower roller bearings 74, 76, respectively, are separated axially by a bearing spacer 78. An external pressurized oil system lubricates the bearings 74, 76 through hydraulic quick connects 80, and is maintained by rotary lubrication bearing seal members 82 above and below the bearing assembly 52. Bearing seal members 82 are stationary even while there is full 360° rotation of stripper assembly 60 and drive ring 50 within outer bowl 48. Since the clamp assembly clamps the rotating side of the bearing assembly, the clamp assembly must also rotate.

The rotary drilling head assembly 46 counteracts forces due to the upward pressure from the returning drilling fluids, the radial wobble of the drill string 14, and the downward engagement forces of drill string 14. The bearing assembly 52 of a conventional drilling head assembly 46 includes tapered roller bearings to enable rotation of the drive ring 50 with respect to the outer bowl 48 and to overcome these various forces. Previous designs utilize two horizontally opposed tapered roller bearings 74, 76 spaced apart axially to handle the loads encountered during drilling operations, as shown in FIG. 2. Because the design of tapered roller bearings allows them to counteract loads in both the thrust and radial directions, the lower set of bearings 76 encounters the upward annular fluid forces and radial wobble forces simultaneously, while the upper set of bearings 74 encounters the downward drill string and radial wobble forces. This arrangement allows radial and axial forces to be countered regardless of the direction that they may be acting upon rotary drilling head 46.

During operation, individual sections of drill pipe 24 are connected to the upper end of drill string 14 with their upper end attached to the lower end of kelly 22. The new section of drill pipe 24 is then lowered through the stripper assembly 60. As the rotary table 18 rotates, rotary table 18 rotates kelly 22 and thus kelly bushing 34 disposed within drive bushing 32 and around kelly 22. As shown in FIG. 3, drive bushing 34 includes an inside cutout geometry 36, an outside geometry 38, and a split cut 40. Inside geometry 36 corresponds to polygonal section 30 of kelly 22, and outside geometry 38 corresponds to a drive bushing seat 32 of a stripper assembly 60 hereinafter described. Split cut 40 facilitates the assembly and disassembly of drive bushing 34 about kelly 22. Drive bushing 34 is slidably engaged both about polygonal section 30 of kelly 22 and within the corresponding geometry of drive bushing seat 32. Kelly bushing 34 thereby allows kelly 22 to pass through the rotary drilling head 46 while also transmitting torque from the rotary table 18 to the drill string 14 and stripper assembly 60 of the drilling head 46 simultaneously.

Stripper rubber 42 seals with drill string 14 as the drill string 14 moves axially through stripper assembly 60. Kelly 22, drill pipes 24, and threaded pipe connections 28 therebetween may be of many different sizes and shapes and yet must pass through stripper rubber 42. Therefore, the stripper rubber 42 of rotary drilling head assembly 46 must be flexible to sealingly engage and accommodate the various sizes of the components of drill string 14. Rubber stripper 42 also diverts the drilling mud through side port outlet 56 of drilling head 46 in maintaining the sealing engagement with drill string 14.

From time to time the stripper assembly 60 must be removed to replace the stripper rubber 42. This requires disconnecting the retaining clamp 62 to release outer housing 66 of stripper assembly 60. When the outer housing 66 is larger than the opening through the rotary table 18, the stripper assembly 60 must be removed from beneath the rig floor 20 which is expensive.

Further, when service intervals dictate, the bearing assembly 52 must be replaced. This requires that the drilling head assembly 46 be dismantled and the bearing assembly 52 lifted out of outer bowl 48. This is done by removing bearing retaining screws 84 that secure bearing assembly 52 to outer barrel 48. Once removed, bearing assembly 52 can be inspected, replaced or repaired if no longer functioning properly. To prevent disrupting operations with time consuming disassembly procedures, the clearance diameters of rotary table 18 and any other equipment between it and rotary drilling head 46 must be larger than the maximum diameter of bearing assembly 52. If smaller rig floor equipment is used, then rotary drilling head assembly 46 must be removed from beneath the rig floor 20 for disassembly.

One major limitation of prior art rotary drilling head designs is that the roller bearing assemblies require a large radial clearance. Thus, prior art drilling head designs either require a large hole in the rotary table 18 or must be removed from beneath the rig floor 20 for dismantling. It is desirable to produce a rotary drilling head assembly 46 that has a small radial clearance that will allow the stripper assembly 60 and bearing assembly 52 to be removed through the opening in the rotary table 18.

During drilling operations, the seals that maintain the lubrication oil on the drilling head bearing packages may fail prematurely. In the event that a lubrication seal is lost, the roller bearings are destroyed and must be immediately replaced. When seal failure occurs, the entire drilling operation must be stopped so that the rotary head bearing assembly 52 can be replaced. To replace the roller bearings, the whole rotating bead must be removed from the well casing. To prevent costly outages and repair regimens, a more durable bearing design that can function following a lubrication seal loss is desirable to minimize down time.

Diamond bearings are disclosed in U.S. Pat. No. 4,410,054 for use in downhole mud motors. The present invention overcomes the deficiencies of the prior art.

SUMMARY OF THE INVENTION

The rotary drilling head assembly of the present invention includes a housing having a bore for receiving a drive member. The drive member has an outer diameter of less than 17½ inches so as to pass through the 17½ inch opening in a rotary table. A bearing assembly is disposed between the housing and drive member allowing the drive member to rotate within the housing and includes an outer stationary portion and an inner rotating portion maintained in place by upper and lower threaded retaining rings. Retaining clamps attach the outer stationary portion to the housing and the rotating portion to the drive member. Rotary seal assemblies isolate the bearing assembly and its lubrication system from the drilling fluid to prevent premature wear and failure of the bearing.

The bearing assembly includes a plurality of opposing disc-like members that have flat bearing surfaces meeting on a substantially planar surface of contact. The disc-like members are preferably made of a polycrystalline diamond material. The highly wear resistant polycrystalline diamond bearing resists drill string and axial loads.

The bearing assembly includes at least two long-lasting diamond bearings to carry axial thrust loads. Each bearing includes annular bearing plates each supporting a plurality of friction bearing members having bearing faces of highly wear resistant polycrystalline diamond to carry the thrust load.

The diamond enhanced bearing of the present invention is more compact than equivalent roller bearing assemblies of the prior art rotary head assemblies. By reducing the space required in the radial dimension, the diamond enhanced rotary drive assembly fits through the opening in, a 17.5" rotary table which was not possible with the over 20" diameter roller bearing design of the prior art. Some current roller bearings are small enough to be retrieved through a 17.5" rotary table but their load carrying capacity is limited by their diminished radial envelope.

Additionally, the diamond enhanced bearing package of the improved rotary drilling head assembly is designed to be symmetrical. In the event that one side of the bearing wears faster than the other, the bearing may be removed and reversed to allow the drilling head to continue in service. Rotary seals are positioned below and above the diamond enhanced bearings of the present invention encapsulating a lubricant fluid that provides lubrication to the bearing members. The use of diamond bearings, however, makes it possible for the bearings to be safely cooled and lubricated by the drilling fluid in the event of a lubrication seal failure.

By incorporating the inherent fail-safe properties of diamond enhanced bearings into the rotary drilling head assembly of the present invention, considerable advances in drilling head life can be achieved. By utilizing a more durable rotary drilling head with a higher maximum rotational speed, production costs can be reduced by both reducing the number of expensive bearing replacement operations and being able to drill at a faster rate than before.

Other objects and advantages of the present invention will become apparent from the following description and claims.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENTS

Figure 1:
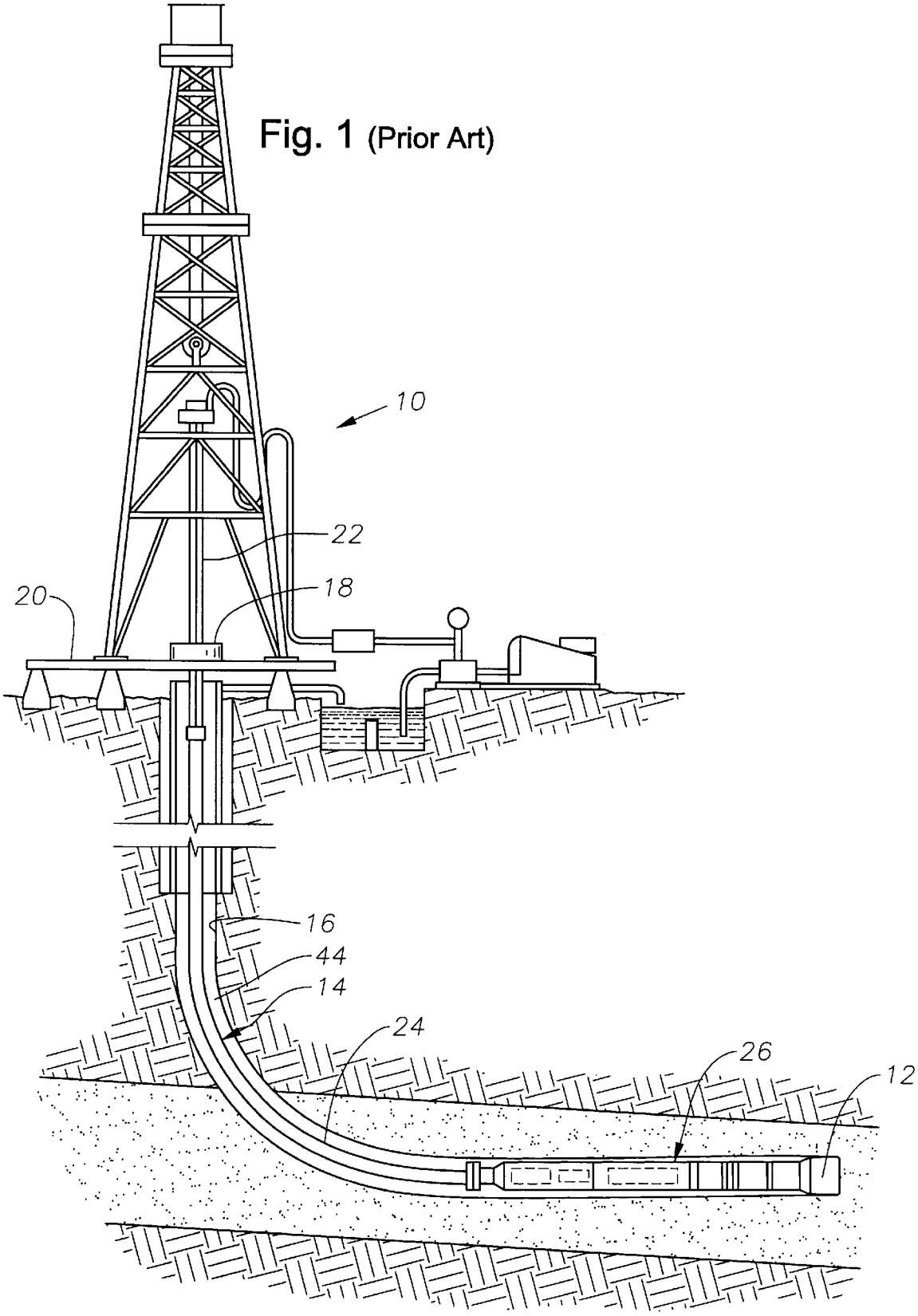
Fig. 1 (Prior Art)
FIG. 1 is a schematic of a conventional drilling system for a well.
Figure 2:
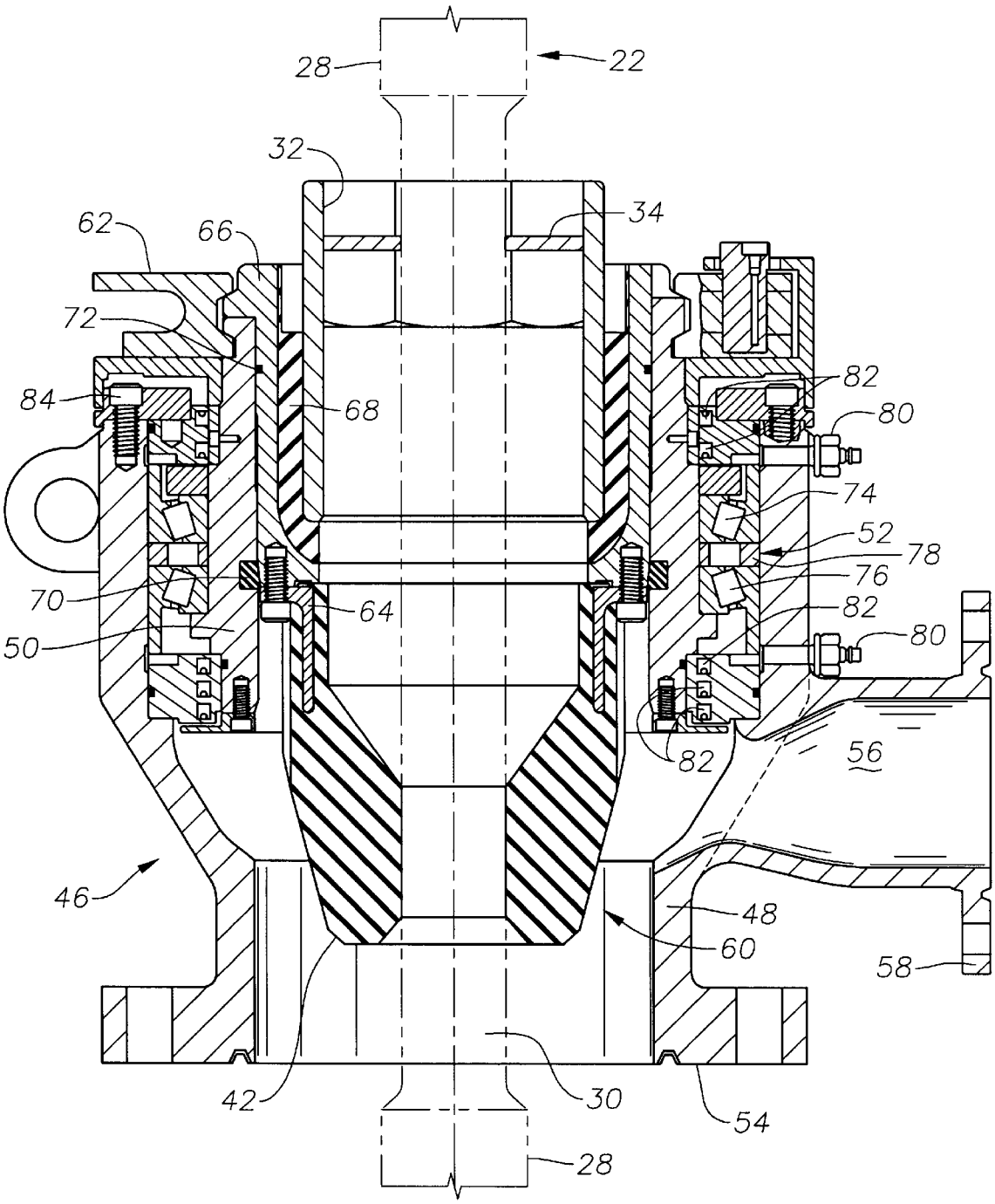
Fig. 2 (Prior Art)
FIG. 2 is a sectional view of a prior art rotary drilling head assembly with roller cone bearings.
Figure 3:
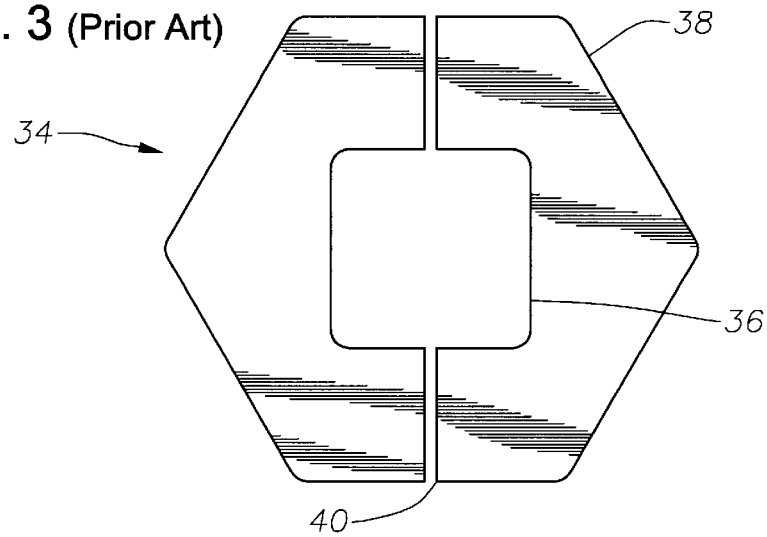
Fig. 3 (Prior Art)
FIG. 3 top view of a kelly bushing for use with the prior art drilling head assembly of FIG. 2.

Referring to now FIGS. 4–8, the rotary drilling head assembly 100 of the preferred embodiment includes an outer stationary housing or bowl 102 and an inner drive ring 104 with a bearing assembly 106 disposed between the drive ring 104 and bowl 102. Assembly 100 further includes a stripper assembly 110 slidably received within drive ring 104 and mounted to the top of drive ring 104 by fastener members such as bolts 108. Stripper assembly 110 includes a drive bushing 112 having a stripper rubber 114 bonded at 116 to its lower end. Seals 118 are provided to seal between drive bushing 112 and drive ring 104.

Outer bowl 102 includes an inlet mounting flange 122 for connection to the BOP stack and an outlet port 124 with a flange 126 for connection to a pipe extending to the mud reservoir. A bushing sleeve 128 is disposed within the upper cylindrical bore 130 in bowl 102. The outer diameter of bushing sleeve 128 is less than the diameter of the opening in the rotary table and typically is 17.5 inches or less so as to allow sleeve 128 to pass through the opening in the rotary table.

Drive ring 104 and bushing sleeve 128 form an envelope for housing bearing assembly 106. A retaining ring 132 is threaded onto the lower end of drive ring 104 to position and retain the bearing assembly 106 within the drive ring 104. Bushing sleeve 128 rests on an upwardly facing shoulder 136 on bowl 102 extending inwardly into bore 130 and also includes a inwardly extending flange 138 forming an upwardly facing shoulder 140. Sleeve 128 is maintained in position by a stationary retaining clamp assembly 142 which engages an outwardly extending flange 144 on the upper end of bowl 102 and bears against the upper terminal end of sleeve 128 forcing sleeve 128 against upwardly facing shoulder 136.

Bushing sleeve 128 also includes upper and lower hydraulic ports 146, 148, respectively, communicating with hydraulic ports 150, 152, respectively, for providing lubricating and cooling fluids to bearing assembly 106. Seals 154 are provided to seal around ports 146, 148. Upper and lower seal assemblies 156, 158 are disposed above and below bearing assembly 106. Each seal assembly 156, 158 includes a seal housing 160 having a passageway 162 communicating with either hydraulic port 146 or 148 and the inner surface of seal housing 160 between a pair of seal grooves housing seal members 164, 166. A check valve 95 is disposed in passageway 162. Upper and lower bushings 168, 170 are disposed between seal assemblies 156, 158 and drive ring 104 with a seal member 101 sealing therebetween.

Figure 7:
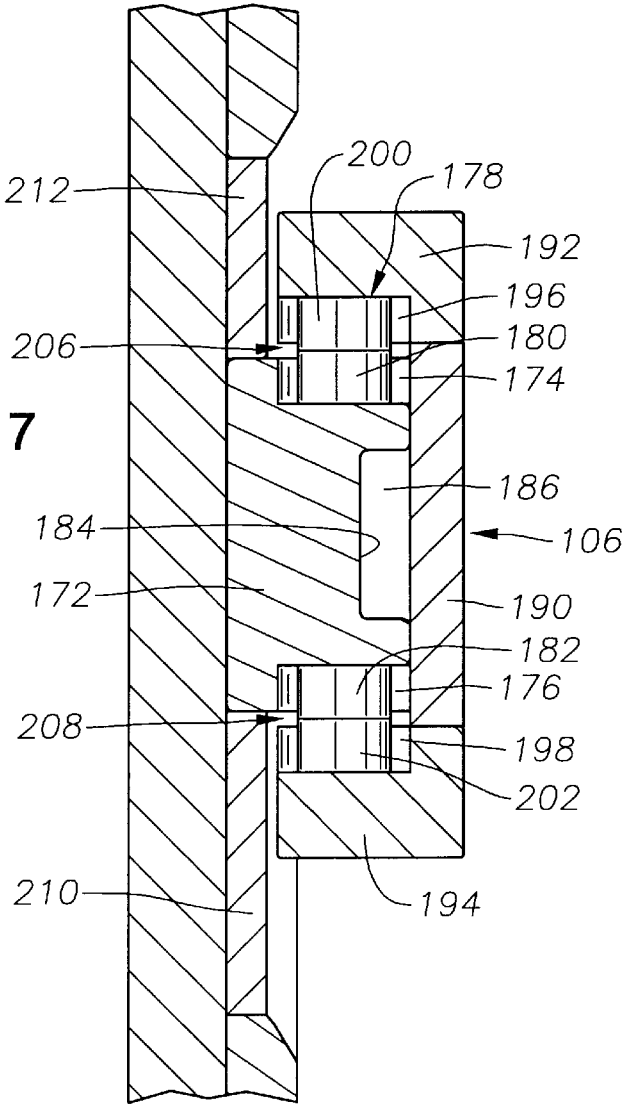
FIG. 7 is an enlarged cross-sectional view of the bearing assembly of the preferred embodiment of the present invention shown in FIG. 4.

Referring particularly to FIG. 7, bearing assembly 106 includes a housing 172 having a plurality of upwardly facing apertures 174 and a plurality of downwardly facing apertures 176 for housing disc-shaped bearing members 178 such as members 180, 182, respectively. Housing 172 also includes a inwardly facing being race 184 for housing a plurality of radial load carrying roller bearings 186, such as needle bearings, equally spaced about the outer diameter of bearing race 184 with their axis extending parallel to the central axis 188 of rotary drilling head assembly 100. Assembly 106 also includes an outer spacer bushing 190 which bears against roller bearings 186. Bearing assembly 106 further includes an upper bearing ring 192 and a lower bearing ring 194, each having a plurality of apertures 196, 198, respectively, for also housing disc-shaped bearing members 178 such as members 200, 202, respectively.

Figure 4:
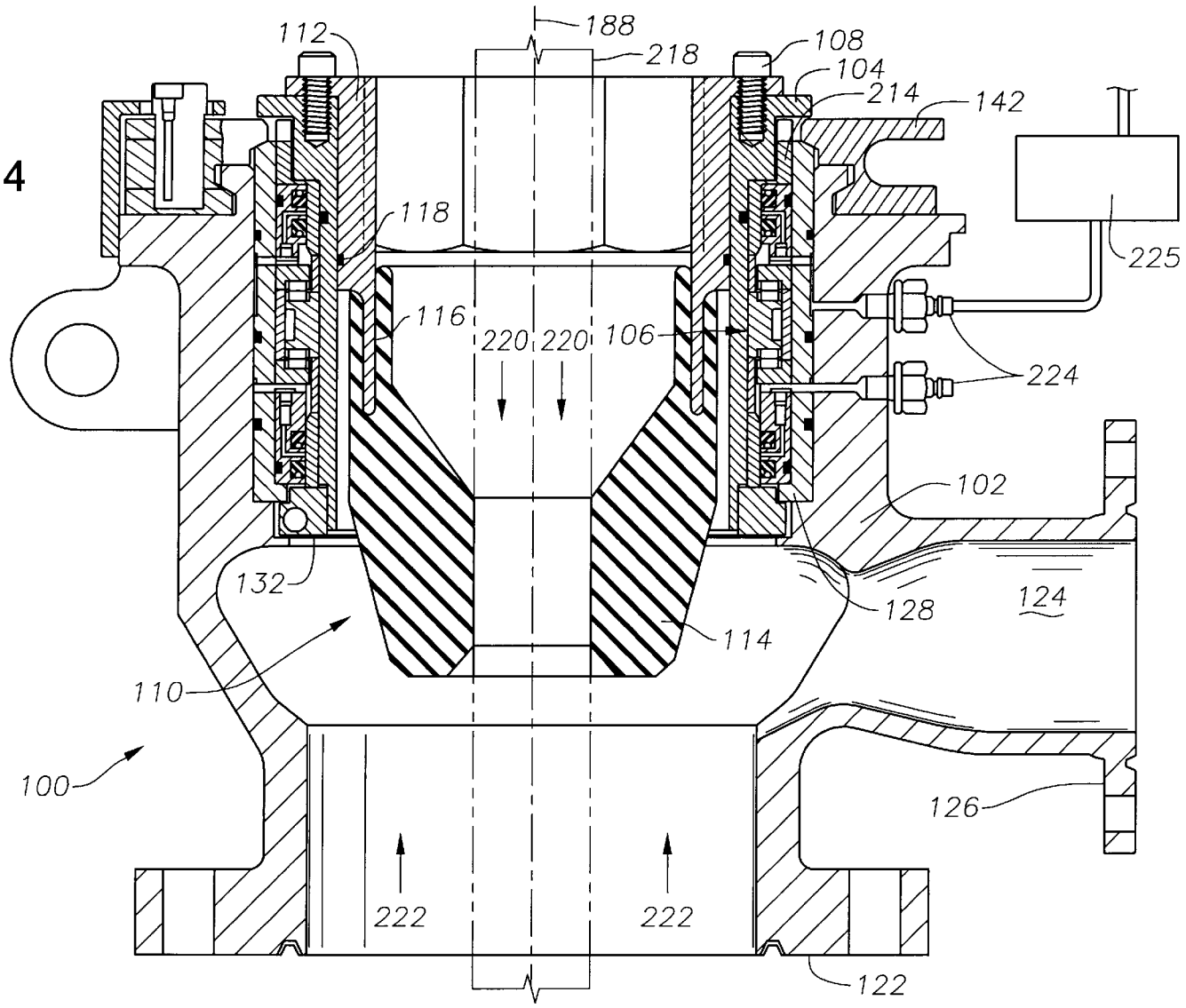
FIG. 4 is a sectional view of a rotary drilling head assembly constructed in accordance with a preferred embodiment of the present invention.
Figure 6:
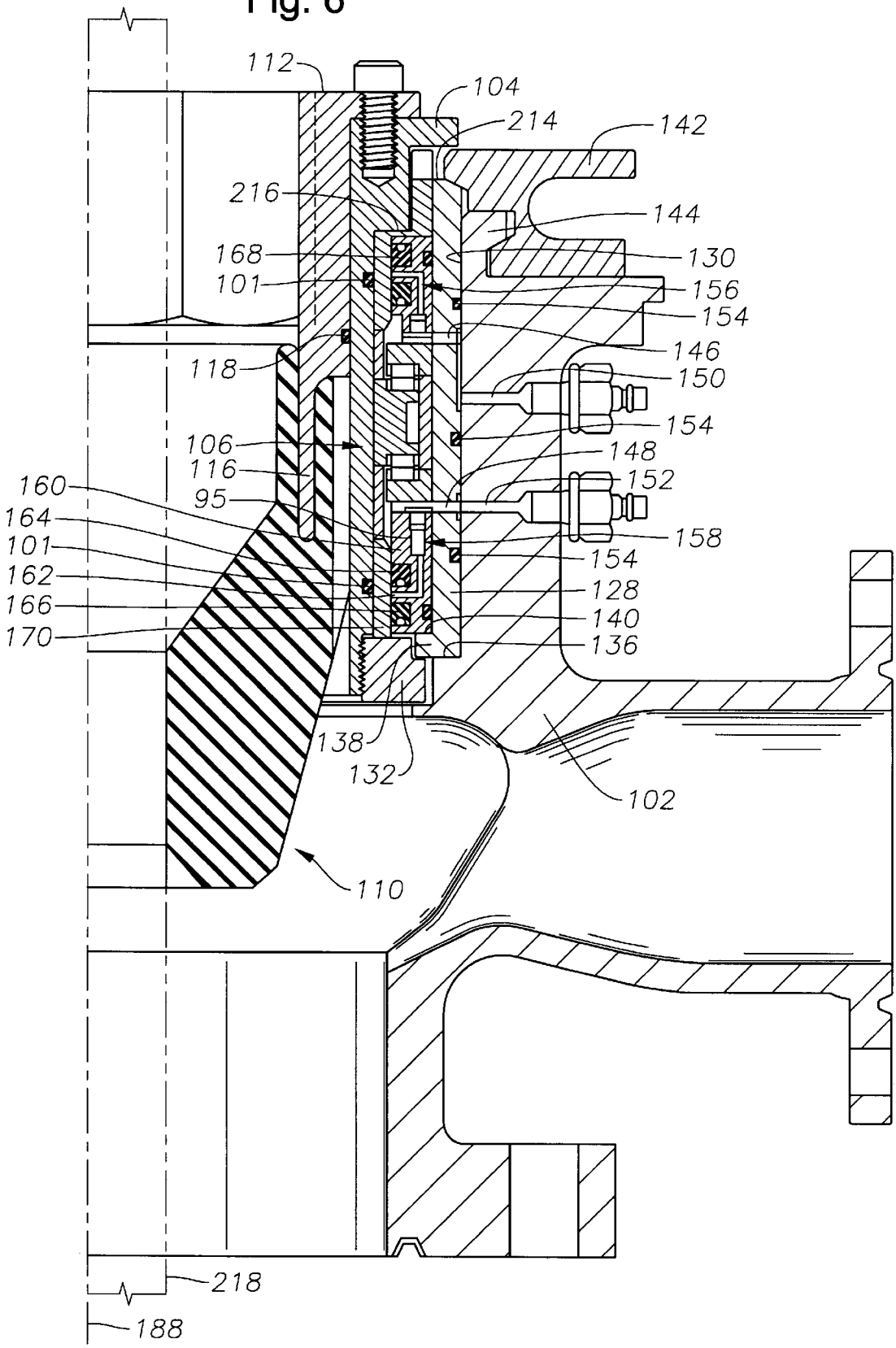
FIG. 6 is an enlarged cross sectional view of one side of the rotary drilling head assembly of FIG. 4.
Figure 8:
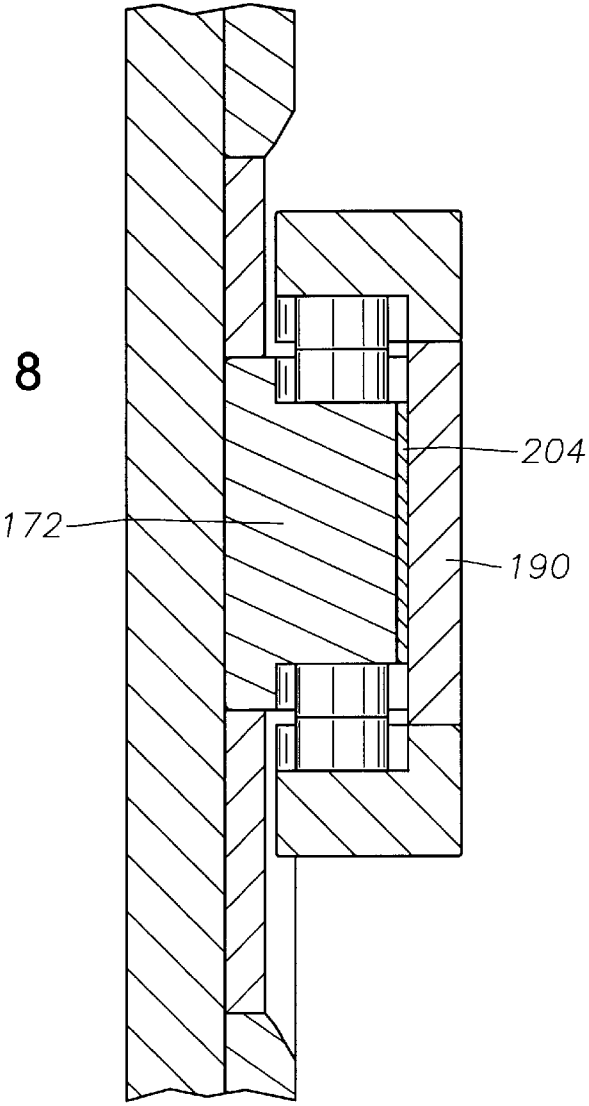
FIG. 8 is an enlarged cross-sectional view of an alternative embodiment of the bearing assembly shown in FIG. 7.

As shown on the left hand side of FIG. 4 and in closer detail in FIG. 8, roller bearings 186 may be replaced by a journal bearing with hard surface facing 204 on the outer radial surface of housing 172. Hardened surface 204 bears against the inner diameter of bushing 190. Hardened surface 204 can also be manufactured of diamond material. Alternatively, instead of disposing the radial bearings 186 between the upper and lower assemblies 206, 208, radial bearings may be disposed outboard of the upper and lower assemblies 206, 208 with radial bearings above the upper bearing assembly 206 and radial bearings below the lower bearing assembly 208 to increase stability and eliminate any pivoting about radial bearings 186.

Bearing members 178 are generally in the shape of cylindrical studs that are secured in their respective mounting apertures by conventional methods and are able to withstand large compressive loads and vibrations. The material of the bearing members 178 is a hard material such as tungsten carbide and is capable of bonding well with the polycrystalline diamond compound that is secured thereon. The diamond substrate is applied to the exposed circular faces and about the periphery of the cylindrical bearing members 178 for the purpose of reducing frictional wear on the members, is extremely wear and heat resistant once applied, and offers performance that well exceeds that of roller bearings. The diamond coated surfaces of each bearing member 178 in their respective mounting ring collectively act as a single hardened bearing surface. The bearing members are preferably cylindrical studs having flat faces with initially flat disc-shaped diamond wafers supported thereon. There is preferably one more of the diamond bearing wafers on one of the annular bearing plates than on the other and it is preferred to have all diamond wafers be of the same size and diameter. Wafers currently manufactured by Megadiamond Industries that are 13 mm in size are acceptable for this application.

The diamond bearing of the present invention utilizes a thrust surface that is only ½" wide radially. Roller bearings of the same load capacity would require 1½" to 2" of radial width. Diamond bearings may save as much as 1" of radial space (at least 2" on the diameter) over the roller bearings of the prior art. To accomplish this space savings with roller bearings, the size of the roller bearings may have to be reduced which would reduce their load carrying capacity. Even though smaller, the diamond bearings exceed the load carrying capacity of the roller bearings by 5 to 10 times.

Diamond bearings are able to run at higher temperatures than other types of bearings under similar loads. The diamond wafers of the present invention do not begin to deteriorate until they reach 1300° F. The diamond bearings allow the rotary drilling head assembly to operate at speeds much higher than previously allowable with roller bearings. Whereas diamond drilling head assemblies utilizing diamond bearings can operate at speeds up to 200 RPM and up to 600 RPM in special situations, current rotary drilling head assemblies typically allow the drill string to only rotate at 100 RPM or less. Since the bearing seal components only operate effectively below 400° F., a chiller system may be required to keep the lubrication system cool.

Upon assembly, upper bearing ring 192 with apertures 196 housing members 200 is disposed opposite upwardly facing apertures 174 with members 180 on housing 172 to form an upper diamond bearing assembly 206. Similarly, lower bearing ring 194 with apertures 198 housing members 202 is disposed opposite downwardly facing apertures 176 with members 182 on housing 172 to form a lower diamond bearing assembly 208. Housing 172 thus provides two arrangements of bearing members 178 that face in opposite directions from each other in the axial direction. This arrangement allows housing 172 to act both as bottom ring for bearing members 180 for upper bearing assembly 206 and as top ring for bearing members 182 for lower bearing assembly 208.

Figure 5:
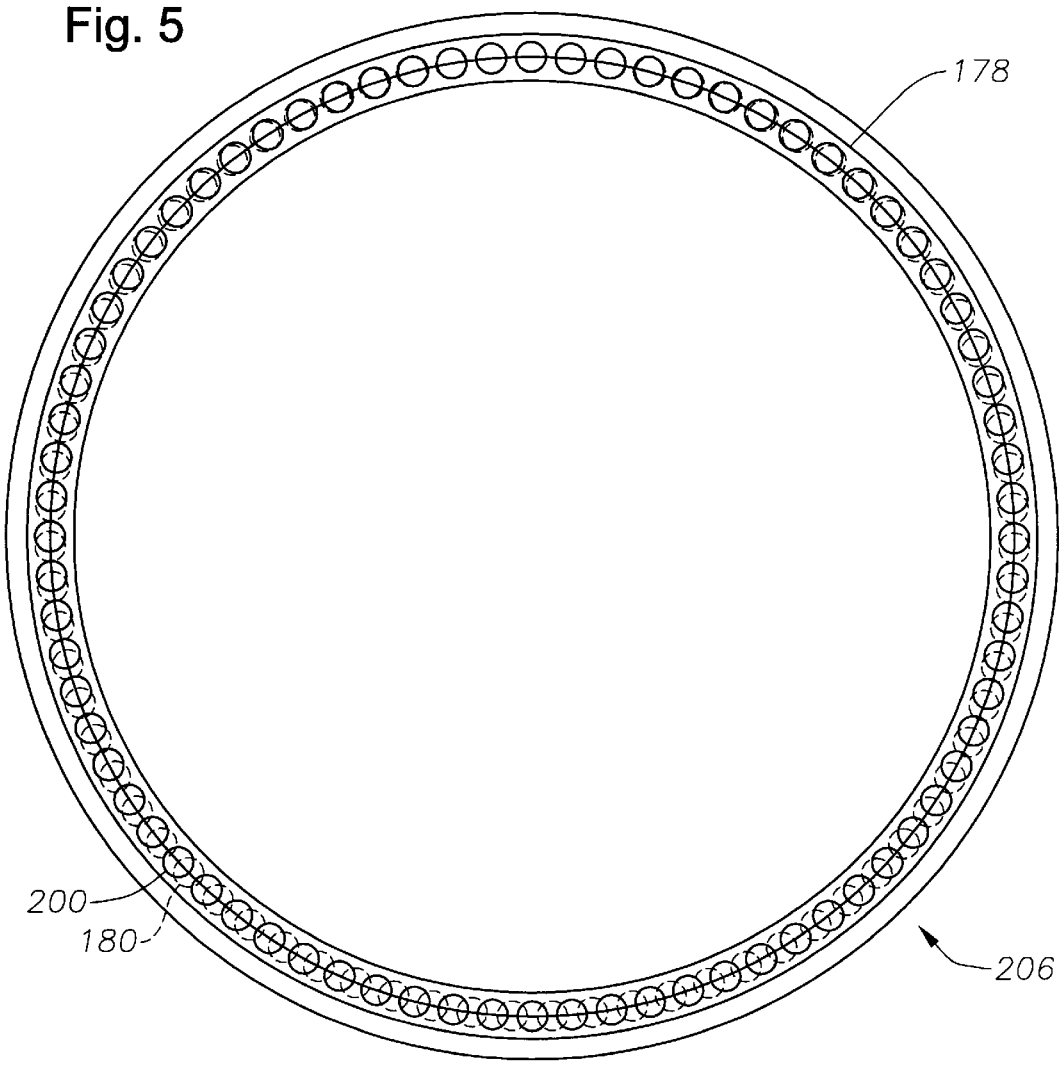
FIG. 5 is a top view of a diamond bearing showing an overlap geometry in accordance with the preferred embodiment of the present invention.

Referring particularly to FIG. 5, upper and lower bearing assemblies 206, 208 thus form upper and lower polycrystalline diamond enhanced thrust bearing surfaces. Each of the two complimentary surfaces are horizontally opposed and include rings of disc-shaped bearing members 178 that are equally spaced into a circular pattern within their mounting plates. To ensure simplicity of design, all bearing members 178 are of a standard size and diameter. Since the bearing members 178 are all of the same diameter, the number of bearing members 178 in each of the two bearing rings within a bearing assembly, 206 or 208, differs in number by one. This difference is necessary to ensure that at any position that the bearing assembly may encounter, no more that one pair of bearing members 178 may line up perfectly with one another such that all other engaging bearing members 178 overlap. Alternatively, bearing members 178 may have different diameters for each bearing ring and yet still accomplish the same result.

In the assembly of the bearing assembly 106 in the envelope formed by drive ring 104 and bushing sleeve 128, an upper retainer ring 214 is threaded onto the upper end of bushing sleeve 128 thereby compressing upper and lower seal assemblies 156, 158 and upper and lower bearing rings 192, 194 with bushing 190 therebetween against shoulder 140. Likewise lower retainer ring, 132 is threaded onto the lower end of drive ring 104 compressing the bushings 168, 170, housing 172, and spacer rings 210, 212 together against a downwardly facing shoulder 216 on drive ring 104.

Housing 172 is thus attached to drive ring 104 and thereby rotates with drive ring 104. The upper and lower bearing rings 192, 194 are attached to the outer geometry of bearing assembly 106 and thus to outer bowl 102. Thus, the bearing rings 192, 194 are stationary and do not rotate.

In operation, as drill string 218 is rotated by the rotary table 18 (shown in FIG. 1), drive ring 104 rotates within outer bowl 102. As the drill string 218 passes downwardly through the stripper assembly 110, downward drill string forces 220 are placed on bearing assembly 106. This causes the bearing members 182, 202 to engage to absorb these downward axial forces on the drilling head assembly 100. The downhole pressure on the returning drilling fluids also places upward annular forces 222 on bearing assembly 106. This causes the bearing members 180, 200 to engage to absorb these upward axial forces on the drilling head assembly 100. Only one bearing assembly 206, 208 engages at any one time. When upper bearing assembly 206 engages, lower bearing assembly 208 separates and disengages and when lower bearing assembly 208 engages, upper bearing assembly 206 separates and disengages. The radial forces on the drilling head assembly 100 caused by the rotation of the drill string 218 are absorbed by the roller bearings 186. Bearing housing 172 and diamond bearing members 180, 182 also rotate within their respective diamond enhanced bearing assemblies 206, 208, serving to counteract axial forces 220, 222 experienced by rotary drilling head assembly 100.

The preferred embodiment of the present invention incorporates a bearing assembly with two bearing systems that each contain sets of horizontally opposed bearing members that meet with each other in a planar geometric fashion. Such an embodiment is highly effective in countering axial thrust loads but does not offer any resistance to radial drill string loads. Since loads in the radial direction are much lower than those in the axial direction, the secondary radial bearing system incorporated into the present invention is in the form of roller bearings 186.

An external pressurized cooling and oiling system 225 communicates through hydraulic quick connects 224 in fluid communication with seal members 164, 166 above and below bearing assembly 106 to cool and lubricate the bearings. System 225 may include an oil chiller. Seal members 164, 166 are constructed to remain in place while allowing full 360° rotation of the mating drive ring 104 with maintenance of seal integrity.

Because forces from the annular return of drilling fluids can be greater than downward drill string forces 220 by 10 times or more, upper bearing assembly 206 wears at a faster rate than lower system 208. To compensate for any uneven wear between bearing assemblies 208, 206, bearing assembly 106 is constructed symmetrically so that it may be removed from rotary head assembly 100, reversed, and reinstalled so that the lesser worn bearing system opposes smaller downward drill string loads 220. By utilizing the less worn bearing system of the assembly in place of the heavily worn bearing system, use of drilling head assembly 100 can be continued on a temporary basis until a replacement bearing assembly 106 can be located and installed.

Alternatively, a cost saving embodiment for the bearing assembly design includes; a diamond bearing assembly to offset the larger annular return forces and a roller bearing assembly to offset the smaller drill string forces. Such an alternative reduces cost but would not be reversible. Where vertical height restrictions are critical, a still further alternative utilizes only one bearing assembly which offsets both upward and downward forces. Such an alternative reduces the vertical height of the drilling head assembly but requires that the stripper assembly 110 float up and down.

When it is time for bearing replacement, stationary retaining clamp 142 is removed and drive ring 104 and bearing assembly 106 are removed through the opening in rotary table 18. The current art design presented is capable being retrieved through a 17.5" clearance rotary table. The prior art presented requires a 22.5" rotary table clearance.

In the alternative to the preferred embodiment, the diamond bearing members 178 of each opposing bearing ring meet each other at a contact surface with a conical profile. Two horizontally opposed conical diamond bearing systems would suffice to oppose both radial and thrust forces encountered in drill string operations. However, to do so, each of the wafers would have to have a concave surface which is properly oriented. The concave surfaces could be created by arranging the initially flat diamond bearing members in a conical arrangement and rotating them under load until they are "broken in" and obtain the conical profiles.

Although the invention is described with particular reference to a rotary drilling head assembly used in well drilling operations, it will be recognized that certain features thereof may be used or adopted for use in other applications. Inventions relating to oilfield well drilling have applications in other industries that also require earth drilling including, but not limited to, the drilling of water wells, underground electrical conduits, fluid pipelines, or geo-thermal energy systems. While the preferred embodiments of the invention have been shown and described, modifications thereof can be made by one skilled in the art without departing from the spirit and teachings of the invention. For example, the relative dimensions of various parts, the materials from which the components are made and other parameters can be varied.

The embodiments described herein are exemplary only, and are not limiting. Many variations and modifications of the invention and the principles disclosed herein are possible and are within the scope of the invention. Accordingly, the scope of protection is not limited by the description set out above, but is only limited by the claims which follow, that scope including all equivalents of the subject matter of the claims.

What is claimed is:

1. A rotary drilling head assembly for disposal adjacent an opening in a rotary table comprising:

a housing having a bore;

a drive member disposed within said bore;

a bearing assembly disposed between said housing and said drive member; and said bearing assembly including a plurality of opposing disc-like members that have bearing surfaces meeting on a substantially planar surface of contact.

2. A drilling head of claim 1 wherein said bearing assembly has an outside diameter less than 17.5 inches.

3. The drilling head assembly of claim 1 wherein said drive member and said bearing assembly are secured within said housing by a stationary clamp assembly.

4. The drilling head assembly of claim 1 wherein said bearing assembly is reversible.

5. The rotary drilling head assembly of claim 1 wherein said disc-like members are comprised of a polycrystalline diamond material.

6. A drilling head of claim 1 wherein said bearing assembly is lubricated by drilling fluids.

7. The drilling head assembly of claim 1 further including a lubrication fluid chiller.

8. The rotary drilling head assembly of claim 1 wherein said bearing assembly includes at least two thrust bearing assemblies and at least one radial bearing assembly.

9. The drilling head assembly of claim 8 wherein said radial bearing is a roller bearing.

10. The drilling head assembly of claim 8 wherein said radial bearing is a friction member bearing.

11. The rotary drilling head assembly of claim 8 wherein at least one of said thrust bearings resists upward forces and at least one of said thrust bearings resists downward forces.

12. The rotary drilling head assembly of claim 8 wherein each thrust bearing assembly includes opposed bearing rings with one bearing ring rotating with said drive member and the other bearing ring being stationary with said housing.

13. The rotary drilling head assembly of claim 12 wherein said opposing disc-like members are mounted to said opposed bearing rings.

14. The rotary drilling head assembly of claim 12 wherein said bearing rings include a plurality of studs arranged in an equally spaced circular geometry.

15. The rotary drilling head assembly of claim 14 wherein said disc-like members are mounted upon said studs.

16. The rotary drilling head assembly of claim 15 wherein said studs within each of said opposed bearing rings are unequal in quantity.

17. The rotary drilling head assembly of claim 15 wherein the diameter of each of said disc-like members within said thrust bearings is non-uniform.

18. The drilling head assembly of claim 15 wherein said disc-like members each include a hard-faced friction surface.

19. The drilling head assembly of claim 18 wherein said hard-faced friction surface comprises polycrystalline diamond.

20. A rotary drilling head assembly comprising:

a housing having a bore;

a drive member disposed with said bore;

a bearing assembly disposed between said housing and said drive member;

said bearing assembly including at least two radial/thrust bearings, each having one bearing member fixed within said housing and another bearing member having rotary bearing contact therewith, supported on and rotatable with said drive member;

said bearings meeting on a substantially conical surface of contact;

said bearing members, after break in, having substantially conical bearing surfaces meeting for smooth rotary bearing contact on said conical surface of contact; and said conical bearing surfaces each having bearing faces of diamond comprising the only bearing surfaces in said radial/thrust bearing.

21. The rotary drilling head assembly of claim 20 wherein said bearing assembly is reversible.

22. A rotary drilling head assembly for disposal adjacent an opening in a rotary table comprising:

a housing having a bore therethrough and an axis;

a drive member disposed within said bore;

a bearing assembly disposed between said housing and said drive member; and said bearing assembly including a plurality of opposing members that have bearing surfaces meeting on a substantially planar surface of contact, said planar surface of contact being substantially perpendicular to said axis.

23. A rotary drilling head assembly for disposal adjacent an opening in a rotary table comprising:

a housing having a bore;

a drive member disposed within said bore;

a bearing assembly disposed between said housing and said drive member;

said bearing assembly including a plurality of opposing disc-like members that have bearing surfaces meeting on a substantially planar surface of contact; and said bearing assembly includes at least two thrust bearing assemblies and at least one radial bearing assembly, said radial bearing including a roller bearing assembly.

24. A rotary drilling head assembly for disposal adjacent an opening in a rotary table comprising:

a housing having a bore therethrough;

a drive member disposed within said bore;

a bearing assembly disposed between said housing and said drive member;

said bearing assembly includes at least two thrust bearing assemblies and at least one radial bearing assembly;

at least one of said thrust bearings resists upward forces and at least one of said thrust bearings resists downward forces; and said thrust bearings each including a plurality of opposing disc-like members that have bearing surfaces meeting on a substantially planar surface of contact.

25. The rotary drilling head assembly of claim 24 wherein each thrust bearing assembly includes horizontally opposed bearing rings with one bearing ring rotating with said drive member and the other bearing ring being stationary with said housing.

26. The drilling head assembly of claim 24 wherein said disc-like members include a hard-faced friction surface.

27. The drilling head assembly of claim 26 wherein said hard-faced friction surface comprises polycrystalline diamond.

* * * * *